US009970270B2

(12) United States Patent
Liu et al.

(10) Patent No.: US 9,970,270 B2
(45) Date of Patent: May 15, 2018

(54) MOVABLE COMBINED SAND CONTROL PIPE OF AXIAL AND RADIAL SLOTTED SCREEN PIPES

(71) Applicant: CHINA UNIVERSITY OF PETROLEUM (EAST CHINA), Qingdao (CN)

(72) Inventors: Yonghong Liu, Qingdao (CN); Renjie Ji, Qingdao (CN); Baoping Cai, Qingdao (CN); Quansheng Zhang, Qingdao (CN); Xiaopeng Li, Qingdao (CN); Qingyun Li, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days. days.

(21) Appl. No.: 14/899,063

(22) PCT Filed: Oct. 20, 2014

(86) PCT No.: PCT/CN2014/000919

§ 371 (c)(1),
(2) Date: Dec. 16, 2015

(87) PCT Pub. No.: WO2016/061707

PCT Pub. Date: Apr. 28, 2016

(65) Prior Publication Data

US 2017/0218736 A1 Aug. 3, 2017

(51) Int. Cl.
*E21B 43/08* (2006.01)

(52) U.S. Cl.
CPC ..... *E21B 43/086* (2013.01)

(58) Field of Classification Search
CPC ..... E21B 43/086; E21B 43/08; E21B 43/088; E21B 43/02
See application file for complete search history.

(56) References Cited

U.S. PATENT DOCUMENTS 6,305,468 B1 10/2001 Broome et al.

FOREIGN PATENT DOCUMENTS

| | | |
|---|---|---|
| CN | 2667153 | 12/2004 |
| CN | 102071914 | 5/2011 |
| CN | 102242622 | 11/2011 |
| CN | 203066943 | 7/2013 |
| GB | 2392178 | 2/2004 |

*Primary Examiner* — Wei Wang
(74) *Attorney, Agent, or Firm* — IP & T Group LLP

(57) ABSTRACT

A sand control screen pipe includes couplings, movable spacer bushes, an outer movable radial slotted screen pipe, a split supporting ring and an inner axial slotted screen pipe. In downhole sand control construction work, a movable combined sand control pipe of axial and radial slotted screen pipes is required to be aligned with an oil layer position, this sand control screen pipe adopts the outer radial slotted screen pipe and the inner axial slotted screen pipe for blocking sand, and the outer radial slotted screen pipe can carry out limited axial movement along the inner axial slotted screen pipe and free rotational motion around the axial line of the inner axial slotted screen pipe, so that the controlled sand can be effectively prevented from hardening and an oil leakage channel is kept smooth for a long time to improve the production efficiency of an oil well.

3 Claims, 2 Drawing Sheets

A-A

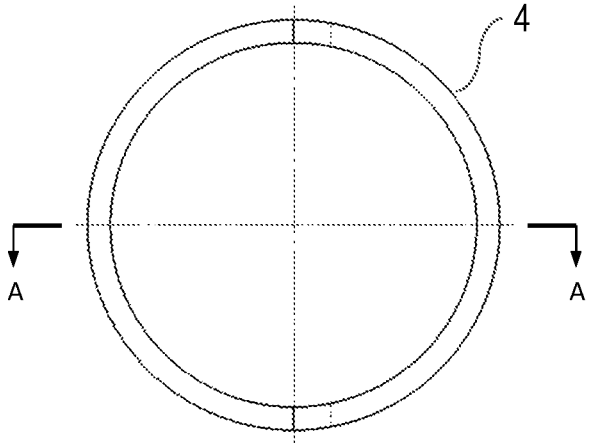
FIG.3
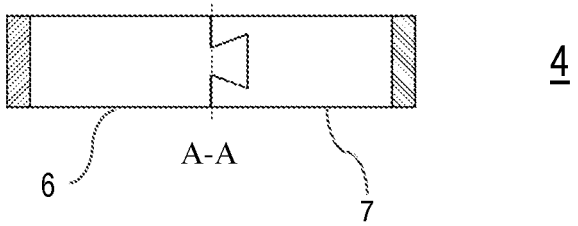
FIG..4

MOVABLE COMBINED SAND CONTROL PIPE OF AXIAL AND RADIAL SLOTTED SCREEN PIPES

This application is a national stage application of PCT/CN2014/000919 filed on Oct. 20, 2014. The disclosure of each of the foregoing applications is incorporated herein by reference in its entirety.

FIELD OF THE INVENTION

The present invention belongs to the field of petroleum downhole tools, and relates to a movable combined sand control pipe of axial and radial slotted screen pipes.

BACKGROUND OF THE INVENTION

Sand production of oil wells is a difficult problem in exploitation a loose sandstone reservoirs, and it not only causes production reduction and production step of the oil wells easily and aggravates the attrition of ground and downhole equipment, but also results in sleeve damage and oil well abandoning in a serious case. It is reported in data that about 40% of oil wells need sand control all over the world, and this proportion is still increasing every year, this is because the mining intensity is higher and higher as the oil fields enter an ultra-high water cut development stage, the oil wells producing no sand originally start to produce sand, and the oil wells producing little sand originally start to produce a large amount of sand. How to effectively prevent and control the sand production of the oil wells is a research subject of petroleum exploitation countries.

Sand control is a main technical measure for solving the sand production problem of the oil wells, and about 80% of sand production oil wells all over the world adopt a mechanical sand control method at present, and the core component of mechanical sand control is a screen pipe. A slotted screen pipe is a most commonly used sand control tool in the oil fields at home and abroad at present, the slot shape of the slotted screen pipe is mostly rectangular, namely the slot width is uniform from outside to inside, and this screen pipe is liable to cause sand plug in the slot to reduce the oil production efficiency and shorten the service life of the screen pipe. A single trapezoidal slotted screen pipe can overcome the easy sand plug problem of the rectangular slotted screen pipe, but the slot thereof is easily expanded by the attrition of fine sand carried by crude oil, resulting in shortened valid period of sand control. A precise composite sand control pipe is well applied in oil wells with fine silt sand production, this screen pipe is composed of an inner aperture pipe, multiple layers of composite sand filtering screens and an outer protection pipe, the outer protection pipe and the multiple layers of composite sand filtering screens are welded on the inner aperture pipe, the deficiency lies in that the multiple layers of composite sand filtering screens are easily plugged by the fine sand carried by the crude oil to reduce the oil production efficiency, the plugging fine sand is difficult to scour and clean, the welds of the pipe bodies are liable to break when being used in thermal recovery oil wells, this screen pipe cannot automatically adjust the positions of the outer protection pipe, the multiple layers of composite sand filtering screens and the inner aperture pipe according to the stratum sand production and sand control conditions, and the controlled sand is liable to harden to reduce the production efficiency of the oil wells.

At present, no literature report on the movable combined sand control pipe of axial and radial slotted screen pipes is available at home and abroad.

SUMMARY OF THE INVENTION

The purpose of the present invention is to provide a movable combined sand control pipe of axial and radial slotted screen pipes, for sand control of oil wells.

The principle of the present invention is as follows: the inventive movable combined sand control pipe of axial and radial slotted screen pipes is composed of couplings, movable spacer bushes, an outer movable radial slotted screen pipe, a split supporting ring and an inner axial slotted screen pipe. The outer movable radial slotted screen pipe is on the outermost layer and is installed on the movable spacer bushes and the split supporting ring; the couplings are connected with the inner axial slotted screen pipe; the movable spacer bushes are installed on the inner axial slotted screen pipe; the split supporting ring is installed in a ring slot of the inner axial slotted screen pipe; the inner axial slotted screen pipe is on the innermost layer and is respectively connected with the couplings, the movable spacer bushes and the split supporting ring. In downhole sand control construction work, the movable combined sand control pipe of axial and radial slotted screen pipes is required to be aligned with an oil layer position, this sand control screen pipe adopts the outer radial slotted screen pipe and the inner axial slotted screen pipe for blocking sand, and the outer radial slotted screen pipe can carry out limited axial movement along the inner axial slotted screen pipe and free rotational motion around the axial line of the inner axial slotted screen pipe, so that the controlled sand can be effectively prevented from hardening and an oil leakage channel is kept smooth for a long time to improve the production efficiency of an oil well.

The present invention has the following advantages:

1. The radial slotted screen pipe and the axial slotted screen pipe are overlapped to form a gap for sand control of the oil well, and when downhole crude oil flows by an outer radial slot and an inner axial slot, the flow direction produces vertical cross change, which is conducive to relieve accumulation and hardening of controlled sand and improve the production efficiency of the oil well.
2. The outer radial slotted screen pipe can carry out limited axial movement along the inner axial slotted screen pipe and free rotational motion around the axial line of the inner axial slotted screen pipe, so that the controlled sand can be effectively prevented from hardening and the oil leakage channel is kept smooth for a long time to improve the production efficiency of the oil well.
3. The shapes of the sectional structures of the radial slotted screen pipe and the axial slotted screen pipe in the slot width direction of the present invention are two trapezoidal slots, which are connected in sequence from outside to inside and have narrow outer parts and wide inner parts, the slot-shaped structure is unlikely to produce sand plug in the slot and can keep the long-time smoothness of the slots, and thus the production efficiency of the oil well is improved.

BRIEF DESCRIPTION OF THE DRAWINGS

FIG. 3 is a schematic diagram of a structure of a split supporting ring.

FIG. 4 is a sectional view of an A-A position in the schematic diagram of the structure of the split supporting ring in FIG. 3.

DETAILED DESCRIPTION OF THE EMBODIMENTS

Figure 1:
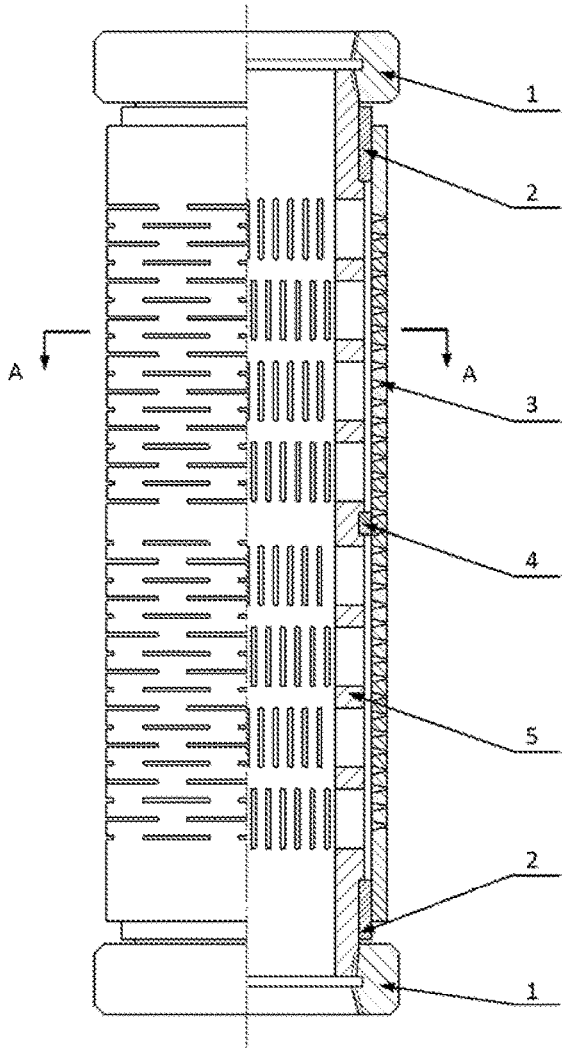
FIG. 1 is a schematic diagram of a contour structure of a movable combined sand control pipe of axial and radial slotted screen pipes.

See FIG. 1, the movable combined sand control pipe of axial and radial slotted screen pipes of the present invention is mainly composed of 5 parts. Two couplings 1, which are respectively connected with both ends of an inner axial slotted screen pipe, are used for limiting the axial movement ranges of movable spacer bushes and an outer movable radial slotted screen pipe on one hand and are used for installing and connecting in sand control work on the other hand; two movable spacer bushes 2, which are respectively installed at both ends of the inner axial slotted screen pipe, can axially move between the shaft shoulder of the inner axial slotted screen pipe and the couplings and can freely rotate around the axial line of the inner axial slotted screen pipe, and are used for supporting the outer movable radial slotted screen pipe, the outer movable radial slotted screen pipe 3, wherein the slot thereof is a slot in the circumferential direction, the shape of the slot width structure of the section along the axial direction is two trapezoidal slots, which are connected in sequence from outside to inside and have narrow outer parts and wide inner parts, the outer movable radial slotted screen pipe is used for blocking sand and providing an inflow channel of crude oil, the outer movable radial slotted screen pipe is installed on the movable spacer bushes and a split supporting ring, and can axially move between the two couplings and can freely rotate around the axial line of the inner axial slotted screen pipe, so that the controlled sand can be effectively prevented from hardening and an oil leakage channel is kept smooth for a long time to improve the production efficiency of an oil well; the split supporting ring 4, which is installed in a ring slot of the inner axial slotted screen pipe, and the split supporting ring is composed of two semicircular rings, is fastened in the ring slot of the inner axial slotted screen pipe by a tenon and mortise structure and is used for supporting the outer movable radial slotted screen pipe; and the inner axial slotted screen pipe 5, which is respectively connected with the couplings, the movable spacer bushes and the split supporting ring and is used for blocking sand, providing the inflow channel of crude oil and supporting the outer movable radial slotted screen pipe.

Figure 2:
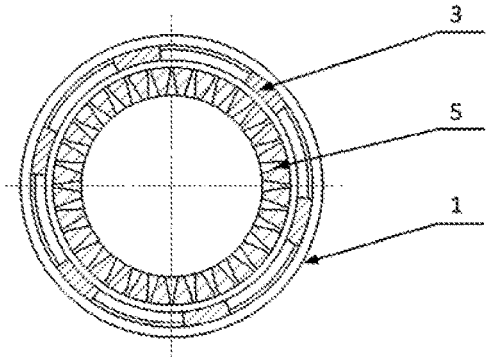
FIG. 2 is a sectional view of an A-A position in the schematic diagram of the contour structure of the movable combined sand control pipe of axial and radial slotted screen pipes in FIG. 1.

See FIG. 2, in the movable combined sand control pipe of axial and radial slotted screen pipes of the present invention, the outer movable radial slotted screen pipe is on the outermost layer, the inner axial slotted screen pipe is on the innermost layer, and the outer movable radial slotted screen pipe and, the inner axial slotted screen pipe are overlapped to form a gap for sand control, and when downhole crude oil flows by an outer radial slot and an inner axial slot, the flow direction produces vertical cross change, which is conducive to relieve accumulation and hardening of controlled sand and improve the production efficiency of the oil well.

See FIG. 3 and FIG. 4, in the movable combined sand control pipe of axial and radial slotted screen pipes of the present invention, the split supporting ring 4 is composed of a semicircular ring with tenons 6 on both ends and a semicircular ring with mortises 7 on both ends, and during installation, the tenons 6 and the mortises 7 of the two semicircular rings are in butt joint and are fastened in the ring slot of the inner axial slotted screen pipe.

The invention claimed is:

1. A movable combined sand control pipe of an inner axial slotted screen pipe and an outer movable radial slotted screen pipe, wherein the sand control screen pipe is composed of couplings, movable spacer bushes, the outer movable radial slotted screen pipe, a split supporting ring and the inner axial slotted screen pipe; wherein two couplings are respectively connected with both ends of the inner axial slotted screen pipe; two movable spacer bushes are respectively installed at both ends of the inner axial slotted screen pipe, and the movable spacer bushes can axially move between a shaft shoulder of the inner axial slotted screen pipe and the couplings, and can freely rotate around the axial line of the inner axial slotted screen pipe; the outer movable radial slotted screen pipe is installed on the movable spacer bushes and the split supporting ring, and the outer movable radial slotted screen pipe can axially move between the two couplings and can freely rotate around the axial line of the inner axial slotted screen pipe; the split supporting ring is installed in a ring slot of the inner axial slotted screen pipe; and the inner axial slotted screen pipe is respectively connected with the couplings, the movable spacer bushes and the split supporting ring.

2. The movable combined sand control pipe of the inner axial slotted screen pipe and the outer movable radial slotted screen pipe of claim 1, wherein the slot of the outer movable radial slotted screen pipe is a slot in the circumferential direction, and the slot of the inner axial slotted screen pipe is a slot in the axial direction.

3. The movable combined sand control pipe of axial and radial slotted screen pipes of claim 1, wherein the split supporting ring is composed of a semicircular ring with tenons on both ends and a semicircular ring with mortises on both ends, and during installation, the tenons and the mortises of the two semicircular rings are in butt joint and are fastened in the ring slot of the inner axial slotted screen pipe.

* * * * *